United States Patent [19]

Buchholz et al.

[11] 4,388,143

[45] Jun. 14, 1983

[54] METHOD AND APPARATUS FOR AFFIXING STRIP LABELS TO CONTAINER CLOSURES

[75] Inventors: Rainer Buchholz, Düsseldorf; Hans-Werner Mohn, Kaarst; Hermann Boms, Ratingen; Rudolf Zodrow, Düsseldorf, all of Fed. Rep. of Germany

[73] Assignee: Jagenberg-Werke AG, Düsseldorf, Fed. Rep. of Germany

[21] Appl. No.: 317,682

[22] Filed: Nov. 2, 1981

[30] Foreign Application Priority Data

Oct. 31, 1980 [DE] Fed. Rep. of Germany ..... 3041057

[51] Int. Cl.[3] ..... B65C 1/00

[52] U.S. Cl. ..... 156/475; 156/492; 156/487

[58] Field of Search ..... 156/475, 486, 492, 482, 156/478, 477 R, DIG. 42, 571, 570

[56] References Cited

U.S. PATENT DOCUMENTS 3,206,348 9/1965 Holstein ..... 156/492

*Primary Examiner*—David A. Simmons

*Attorney, Agent, or Firm*—Sprung, Horn, Kramer & Woods

[57] ABSTRACT

In the affixing of strip label closures across the top and down the sides of a container wherein a strip label is coated with glue, held extended and at right angles to the axis of the container above its top whereby portions of the strip label overhang the top of the container, and the overhanging portions are pressed onto the opposed sides of the container, the improvement which comprises gripping the free ends of the strip label while the label is held extended over the top of the container, guiding the gripped ends over arcuate paths that are in the same plane as the axis of the container directly to the intended points of adhesion on the sides of the container, and thereafter effecting the pressing. A corresponding apparatus is described. Strip labels are thereby affixed more precisely and neatly.

36 Claims, 17 Drawing Figures

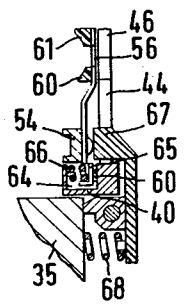
FIG. 3
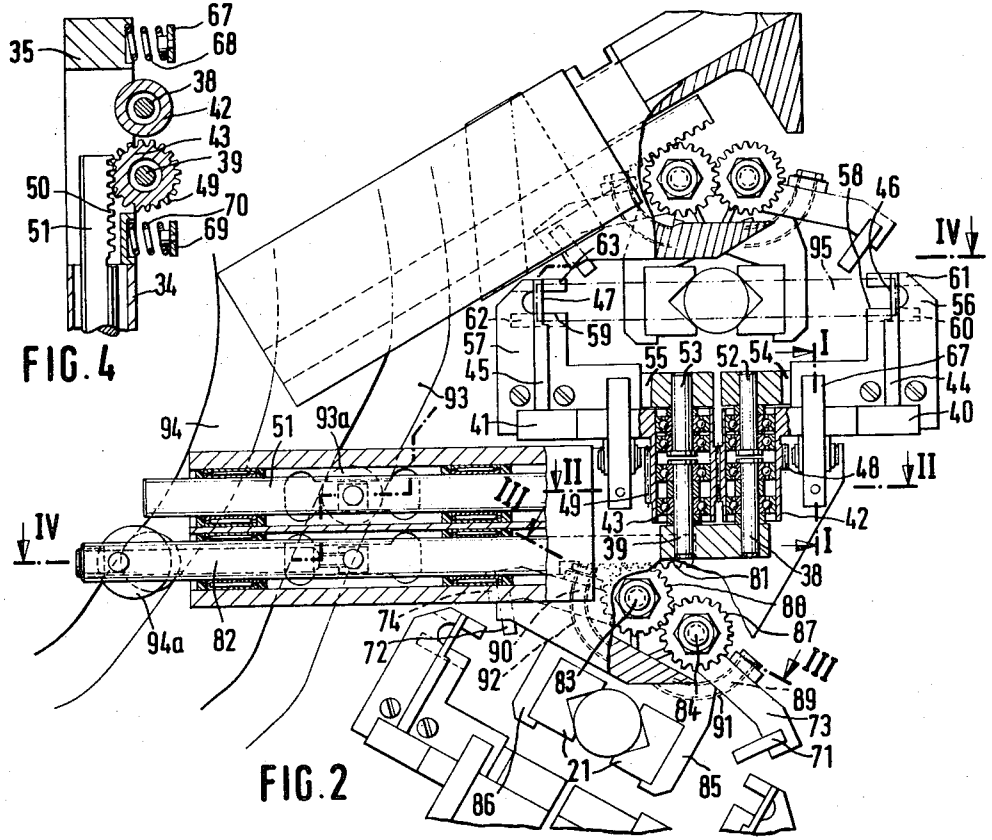
FIG. 2
FIG. 4

METHOD AND APPARATUS FOR AFFIXING STRIP LABELS TO CONTAINER CLOSURES

BACKGROUND OF THE INVENTION

The invention relates to a method for affixing strip labels to container closures wherein the glue-coated strip label, held extended and at right angles to the axis of the container above its top, is pressed by its portions which overhang the top of the container onto the opposed sides of the container.

The invention further relates to an apparatus for affixing strip labels to container closures, and in particular to bottle closures, which comprises a transfer mechanism for the strip labels and applicator means adapted to advance toward two opposed sides of the container to be strip-labeled and to press the strip label onto the container.

A strip label so affixed serves to seal the closure of the container. The container then cannot be opened without the strip label being destroyed. By checking the label for damage, the consumer can tell whether the container filled by the original vendor has been tampered with. Moreover, the strip label can be a revenue stamp. In many countries, bottles filled with alcoholic beverages are required to be sealed with such revenue stamps.

Apparatuses for affixing strip labels to bottle closures have long been known. In one of these prior-art apparatuses (German Pat. No. 224,143), a glue-coated label is moved by a transfer mechanism at right angles to the axis of the bottle to a point above the bottle and transferred to holding means. By means of an applicator which can be axially advanced toward the top of the bottle, the label so held in position is then pressed against the top of the bottle and affixed thereto while being released by the holding means. The portions of the label overhanging both sides of the top are then pressed against the neck of the bottle by applicators operating in the manner of tongs. In the process, these overhanging portions may shift sideways, with the result that they are not adhered straight. Now labels which are askew detract from the desired pleasing appearance of the bottle.

Even in modern apparatuses the overhanging label portions are applied without being guided, either by means of applicators operating in the manner of tongs (U.S. Pat. No. 3,049,166 and German Patent Application DAS No. 1,297,530) or through affixing means (U.S. Pat. No. 3,663,336 and German Patent Application DOS No. 2,055,417).

In another prior-art apparatus for affixing strip labels (British Pat. No. 730,408), the strip label is held in the middle by a plunger and at the ends of gripping blocks by suction. The strip label is applied to the top of the bottle by axially advancing the latter toward the plunger, which is resiliently mounted in a head also carrying the gripping block. As the bottle continues to advance toward the plunger, the latter retracts into the head. In the process, the label is stripped from the gripping block, and the ends of the strip label therefore are no longer held. Applicators provided in the gripper head are radially advanced over oblique surfaces and press the free label ends against the bottle. In this apparatus, too, the ends of the label, initially held by the gripping blocks, are applied to the sides of the bottle head unguided.

SUMMARY OF THE INVENTION

The object of the invention is to provide a method and an apparatus for the affixing of strip labels whereby such affixing is performed rapidly, yet with precision.

In accordance with the method outlined at the outset, this object is accomplished in that the strip label, held extended over the top of the container, is gripped by its free ends, which are then guided over arcuate paths that are in the same plane as the axis of the container directly to the intended points of adhesion on the sides of the container.

With the invention, the label, before being adhered to the container sides, is brought into the exact position in which it is to be affixed through guidance of its ends. And since it is guided in one plane, it is not deformed. The stresses on the label are minor. Since the ends of the label are guided all the way to the sides of the container, the risk that the label might shift sideways while being pressed on is eliminated.

The path over which the ends of the label are guided may be adapted to the geometry of the container. It has been found advantageous for the arcuate paths to be congruent with circular paths whose centers are approximately coincident with the transitions from container top to container sides. When that is the case, the label can be applied without tensile stresses. If, on the other hand, it is desired to draw the strip label tautly across the container, then this can readily be accomplished by slightly offsetting the centers of the circular paths relative to the vanishing lines toward the container.

An apparatus of the type outlined at the outset which operates on the principle there described is characterized in that two gripping members are provided for picking up the strip label from the transfer mechanism, said gripping members grasping the free ends of the strip label, held by the transfer mechanism over the container, and carrying them from that pickup position over paths which are in the same plane as the axis of the container into a transfer position at the sides of the container. The gripping members may be carried by pivot arms whose pivot axes are in proximity to the point of intersection of a line lying in the plane of the top of the container and a line lying in the plane of the side of the container. To subject the label to tensile stress as it is being applied, the pivot axes may be slightly offset relative to the point of intersection of a line lying in the plane of the top of the container and a line lying in the plane of the side of the container.

Since the strip label is picked up directly by the gripping members and its ends are carried over predetermined paths to the side of the container, precise positioning coupled with extremely gentle handling of the label is assured.

When the gripping members are provided with gripper blocks from which the applicators strip the ends of the strip label in the transfer position at the sides of the container and press them against the sides of the container, applying and affixing are separate functions. Separation of these functions contributes to labeling precision. In the prior art, one member serves both functions.

In accordance with one feature of the invention, provision for easy stripping of the labels from the gripper blocks and for pressing the labels on especially in the label area grasped by the gripper blocks is made by providing the gripper blocks with notches which are open on the pivot-axis side to allow penetration by the applicators and passage of the ends of the label.

On their backs facing the container to be labeled, the gripper blocks may be provided with press pads. After the ends of the label have been stripped from the gripper blocks, they can be pressed by means of these press pads, over the end portions not covered by the applicators, against the sides of the container to be labeled. Since the area of adhesion is thus enlarged, the adhesive power is enhanced so that the label is not apt to shift on the container even if further pressing should be required.

When the label transferred by the transfer mechanism to the gripper blocks is glue-coated also in the area where it rests on the gripper blocks, its adhesive power will usually be sufficient to hold the label to the gripper blocks. However, a gripper finger may additionally be associated with each gripper block to secure the label to the gripper block. To prevent fouling of the label with glue by said gripper finger, which bears on the face of the label, provision is made in the preceding gluing station for the application of glue to the label to be limited in such a way that the ends of the label remain free of glue over a narrow area of a few millimeters which in the transfer of the label to the gripper block brushes over the gripper fingers.

A simple and space-saving design for the apparatus can be obtained through the design features set forth below.

In accordance with one such design feature, each gripper finger is carried by a pivot arm that is pivotable about the pivot axis of the associated gripper block.

A spring urging the gripper block against the gripper finger may be provided between the pivot arm of each gripper finger and the freely pivotable pivot arm of the associated gripper block. This coupling of the pivot arms of the gripper block and of the gripper finger makes it possible to actuate gripper block and gripper finger by means of a single drive. When a stop operative in the transfer position is associated with the pivot arm of each block, then the pivot arm of the gripper finger in its pivoting movement will entrain the pivot arm of the block until the latter strikes the stop. Because of the spring tension, only the gripper finger can then be moved further to lift off the block. Gripper block and gripper finger are then in a position ready to receive the label.

Since the stop will usually be located so that the gripper blocks are on the level of the top surface of the container, difficulties may arise in conveying the containers into the apparatus. Bottles in particular may have a height tolerance of several millimeters, and collisions might therefore occur. To avoid such difficulties, the stop is preferably supported on a spring that is stronger than the spring between the pivot arms. By overcoming the force of this spring, the pivot arms can then be moved further to provide sufficient free space between the gripper blocks and the top surfaces of the articles to be conveyed into the apparatus.

In accordance with a further feature of the invention, at least one of the gripper-finger pivot arms is coupled to a drive, and in particular to a cam-controlled drive. When only one pivot arm is coupled to the drive, it will be advisable to couple the pivot arms of the gripper fingers together through meshing pinions and to the drive through a rack meshing with one of the pinions.

In a manner analogous to the mounting of the pivot arms of the gripper blocks and of the gripper fingers, the pivot arms of the applicators for the label end portions and of a clamp for securing the articles against rotation below the area to be labeled may be pivotable about the same pivot axes.

To simplify actuation of the applicators and of the clamp, it is contemplated, in accordance with one feature of the invention, to support the associated freely rotatable clamp pivot arm on each applicator pivot arm by means of a spring. The applicator and clamp pivot arms are preferably coupled to a drive, and in particular to a cam-controlled drive. The pivot arms of the applicators may also be coupled to each other through meshing pinions and to the drive through a rack meshing with one of the pinions.

For a compact arrangement, the pivot axes of the pivot arms of the gripper blocks and of the gripper fingers are best at right angles to the pivot axes of the applicators and of the clamp.

Since gripper blocks and gripper fingers as well as applicators and a clamp must be provided for each article to which a strip label is to be applied, it will be advantageous in many respects to provide, in the case of a plurality of applicators pairs and gripper-block pairs arranged in a row in the direction of travel of the containers to be labeled, an applicator pair each, optionally with a clamp, on one side and a gripper-block pair each, optionally with gripper fingers, on the opposite side of a carrier common to both, constructed as an interchangeable unit. With this arrangement, the elements disposed on a given carrier will act simultaneously upon two containers being conveyed in a row.

Preferably a plurality of such units is disposed on a turret comprising a number of pockets for the containers to be labeled that corresponds to the number of said units, the pivot axes of the pivot arms of the gripper blocks being approximately parallel to the direction of travel of the containers to be labeled. Such a design will result in a compact arrangement of the units on the turret. Since the racks are disposed in proximity to the center of the turret, the outer area of the turret is available for accommodation of the gripper blocks and of the applicator means.

The drive for the racks can then consist of fixed cams and cam followers for the racks.

A suitable transfer mechanism is the gripper cylinder of a labeling station.

For the transfer of the labels from the transfer mechanism to the gripper blocks, the transfer mechanism is provided with advanceable applicators for the end portions of the label. For advancing the applicators, a follower may be provided which causes the applicators to follow the contour of a disk cam during the rotation of the turret. The cam profile then is such that at the instant that the gripper blocks are passed the applicators are advanced and transfer the label to the gripper blocks.

Unless special measures are adopted, there is the danger with advanceable applicators that the applicators, which make direct contact with the gripper blocks when the applicator means are not supplied with labels, will be fouled with glue remaining on the gripper blocks. When the transfer of labels then is resumed, that glue will get on the face of the label.

In accordance with one feature of the invention, this drawback can readily be overcome by providing a positioning member whereby the disk cam can be positioned in such a way that the point at which the applicators are advanced is offset relative to the gripper blocks. While the applicators in this case are still radially advanced, they run idle.

When the applicator means are disposed on a turret, one of the gripper blocks will be closer to the axis of rotation than the other, with the result that the two gripper blocks will move at different rates. To permit the label to be transferred to the gripper blocks and the bottle top at as nearly the same rate as possible, the applicators for the end portions of the label may be guided in the guide track which accelerates or retards the applicators as they are advanced toward the container and the gripper blocks, with a view to coordinating their rates of movement. This guide track may take the form of a coarse thread.

The transfer mechanism, constructed in particular as a gripper cylinder, may be associated over its circumference with applicator means for a hot-melt adhesive, and in particular spray nozzles actuable in spurts, whereby the hot-melt adhesive can be applied to areas in the middle and at the ends of the label which do not come into contact with the gripper blocks. With such applicator means, a quick-setting hot-melt adhesive can be applied as desired to specific spots on the label, and this locally applied adhesive will then result in instant fixation of the label that has been pressed on the bottle. The label is then less likely to shift as it is acted on further.

The applicator means in accordance with the invention, which comprises the transfer mechanism, may be located at the entrance or exit of a labeling station for belly and/or breast and/or neck labels. Preferably it precedes the infeed starwheel or follows the outfeed starwheel of the labeling station.

In order that the strip label may be placed in alignment with the belly label or the like, there may, in accordance with a further feature, be associated with each pocket of the outfeed starwheel of a labeling station a clamp which picks up the container to be labeled, in the angular position in which it is oriented, from its pocket in the turret of the labeling station and transfers it in that position to a clamp on the turret carrying the applicator means.

Pressing the strip label onto the top surface and sides of the container will adequately seal the container. However, if it is desired to affix the label completely to the sides, this can be accomplished by means of an affixing brush past which the container is laterally moved.

Said affixing brush is preferably located at the exit of the turret carrying the applicator means and constructed as a rotating circular brush. Allowing for the conveying speed of the container and the peripheral speed of the brush, the axis of the brush is disposed at such an angle that the portion of the brush which is effective at a given instant is parallel to the desired affixing direction, that is to say, in the case of a bottle provided with a strip label is parallel to the axis of the bottle.

With such a brush, the label is acted upon only in its longitudinal direction. No lateral forces that would fold over or damage the edges of the label are generated. Since the brush makes contact with the article only over a helical area, its complement of bristles has a corresponding pattern. The width of the complement of bristles of the brush in the conveying direction is advantageously equal to the width of the label to be affixed.

In order that the label may be affixed as tautly as possible even when it has not been drawn tautly across the container by the gripper blocks, it is contemplated, in accordance with a further feature of the invention, to locate the lowermost part of the brush at the entrance of the article into the brush section. With this arrangement, the label is drawn downward from its adhered end portions. This can be done because the upper portions of the label have not been adhered as yet.

When the articles move over a curved path, the brush is convex on the inside of the path and concave on its outside.

The brush may be followed along the conveying path of the containers by radially resilient press-on rollers, the first of these in the direction of travel being driven in synchronism with the conveying speed of the containers.

BRIEF DESCRIPTION OF THE DRAWINGS

The invention will now be described in greater detail with reference to the accompanying drawings, wherein:

FIG. 2 is a fragmentary top plan view, partly sectional, of a turret equipped with applicator means;

FIG. 3 is a sectional view of part of the applicator means, taken along the line I—I in FIG. 2;

FIG. 4 is a sectional view of another part of the applicator means, taken along the line II—II in FIG. 2;

DETAILED DESCRIPTION OF THE INVENTION

Figure 1:
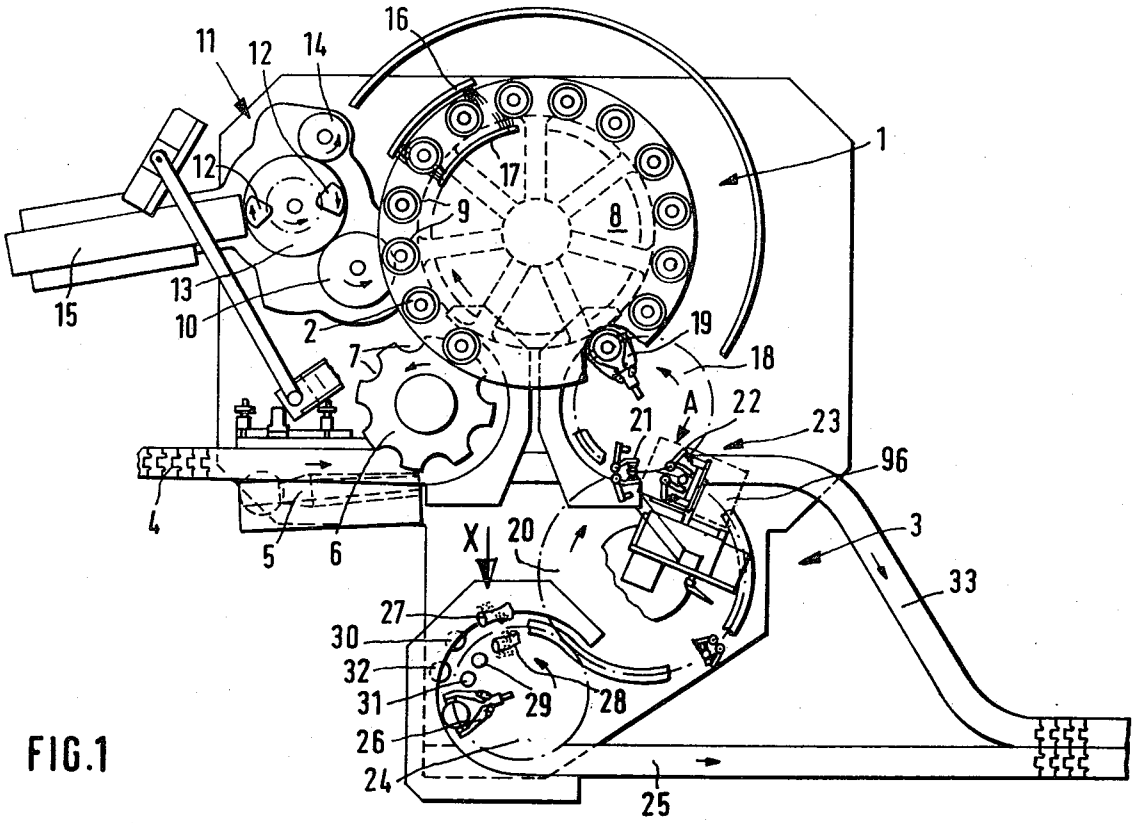
FIG. 1 is a diagrammatic top plan view of a labeling machine for belly and strip labels.
Figure 5:
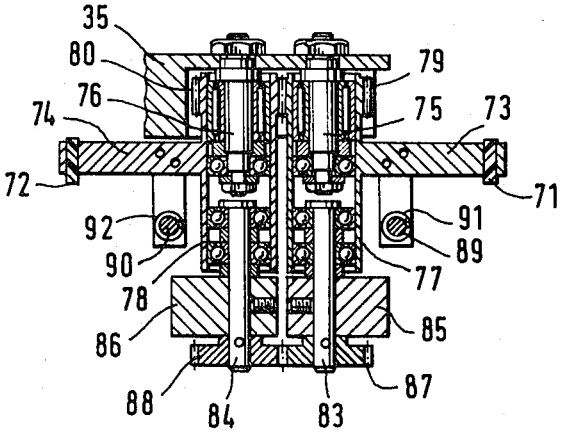
FIG. 5 is a sectional view of still another part of the applicator means, taken along the line III—III in FIG. 2.
Figure 6:
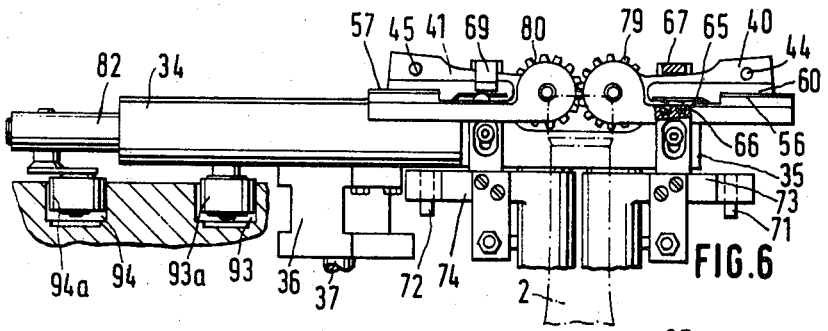
FIGS. 6 to 8 are side elevational and partial sectional views, taken along the line IV—IV in FIG. 2, of the applicator means showing its gripper block and gripper fingers in various positions.

In the machine shown in FIG. 1, bottles 2 are provided in machine section 1 with belly labels and in machine section 3 with strip labels. The bottles 2 are fed by an apron conveyor 4 in the upright position and individually in a row to a revolving spacer worm 5 which separates the bottles 2 by a distance corresponding to the spacing of the peripheral pockets 7 of an infeed starwheel 6. The latter transfers the bottles 2 to a turret 8 whose pockets 9 are provided with a turntable (not shown) for the bottom of the bottle and a bell (likewise not shown) which grasps the top of the bottle, these two means permitting the bottle 2 to be rotated into a particular angular position and to be held in that position. The turret 8 moves the bottles 2 past a gripper cylinder 10 of a labeling station 11 which comprises a rotating carrier 13 provided with pickup members 12, a glue roll 14, and a label magazine 15. Such labeling machines are known. (German patent applications Ser. Nos. DAS 2,352,244 and DOS 2,843,602.)

After the gripper cylinder 10 has applied the label to be transferred to the belly of the bottle 2, the latter in its onward movement is rotated about its own axis and moved past affixing brushes 16 and 17 which affix the label completely to the belly of the bottle. Through the turntable and the bell, the bottle 2 is brought into the desired angular position for transfer to an outfeed starwheel 18.

The outfeed starwheel 18, which in the drawing is shown merely in outline, is constructed like the infeed starwheel 6, shown in detail. The spacing of its peripheral pockets is the same as in the turret 8. Moreover, a cam-controlled clamp 19 operating in the manner of tongs is associated with each pocket. The clamps 19 pick up the bottles 2, in the angular position in which they are oriented, from the turret 8 and carry them to a further turret 20, which in FIG. 1 is also shown merely in outline, and which like the infeed starwheel 6 has peripheral pockets for the bottles to be accommodated, the spacing of said pockets corresponding to that of the outfeed starwheel 18. Moreover, clamps 21 are associated with each pocket of the turret 20 which pick up the bottles 2, in the angular position in which they are oriented, from the clamps 19. The clamps 21 form part of a means 22, described in detail further on, for applying a strip label.

Disposed above the path of the bottles 2 through the turret 20, at a point 23 indicated by an arrow, is a labeling station for strip labels whose construction corresponds to that of the labeling station 11 but which is displaced 90 degrees relative to the axis of the turret 20 so that the generatrix of its gripping cylinder, to which the strip labels to be transferred are parallel, is normal to the direction of travel of the bottles 2.

The bottles 2 provided with strip labels are moved by an outfeed starwheel 24, shown merely in outline, to an apron conveyor 25 which carries the labeled bottles 2 away. The outfeed starwheel 24 is constructed like the outfeed starwheel 18 and is provided with clamps 26 which hold the bottles 2 in the position in which they were picked up from the turret 20. Holding the bottles 2 in that angular position is important when brushes 27 and 28 and/or rollers 29 to 32 are provided along the path of the bottles 2 in proximity to the outfeed starwheel 24 for completely affixing the strip labels to the sides of the bottles 2.

If the bottles 2 are to be provided in the machine only with belly labels or the like, the bottles 2 may be routed from the outfeed starwheel 18 directly to an apron conveyor 33, thus bypassing the turret 20 with the applicator means for strip labels. In that case, the turret 20 is raised out of the way of the bottles 2, or then the applicator means 22 is removed from the area where it is in contact with the outfeed starwheel 18 and a diverter switch is inserted to permit the bottles 2 to be transferred by the outfeed starwheel 18 without interference to the apron conveyor 33.

As may be seen from FIGS. 2 to 8, each applicator means 22 comprises a carrier composed of two assembled parts 34 and 35. Part 34, located in proximity to the center of the turret, is constructed as a rectangular box and on its underside is provided with a foot 36 that fits into an appropriately shaped recess in the turret 20 and can be secured to the turret 20 by means of a threaded bolt 37. This mounting method makes it possible to replace the entire applicator means 22 quickly as a unit in a changeover to a different bottle size, or to remove it when belly or breast labels alone are to be affixed.

In the forward part 35 of the carrier, pivot arms 40 and 41 are pivotably mounted by means of sleeves 42 and 43 which are set onto horizontally disposed parallel studs 38 and 39. At their free ends, the pivot arms 40 and 41 carry laterally projecting gripper fingers 44 and 45 in the form of cylindrical rods which are parallel to the studs 38 and 39 and each of which is provided at its free end, on the side of the pivot axis, with a notch 46 and 47, respectively, extending as far as the middle of the rod.

On their outer circumference, the sleeves 42 and 43 carry pinions 48 and 49 which are in mesh with each other. Pinion 49 extends axially beyond pinion 48 and in the region in which it so surmounts it meshes with the teeth 50 of a rack 51 that is axially guided in part 34. (FIG. 4.) A displacement of the rack 51 will produce a pivoting movement of both pivot arms 40 and 41.

Mounted for free rotation in the sleeves 42 and 43 by means of studs 52 and 53 are pivot arms 54 and 55 which at their free ends carry platelike gripper blocks 56 and 57 that cooperate with the gripper fingers 44 and 45. In the gripper blocks 56 and 57 there are provided, in proximity to the notched ends of the gripper fingers 44 and 45, notches 58 and 59 which are open on one side and are directed toward each other. On the sides facing away from the gripper fingers 44 and 45, the gripper blocks 56 and 57 are provided with press pads 60, 61, 62 and 63 next to the slots 58 and 59.

As is apparent in FIG. 3 from the example of the right-hand pivot-arm pair 40 and 44 of FIG. 2, pivot arm 40 has a longitudinal groove 64 into which the pivot arm 54 penetrates by a boss 65 formed by a receding plate portion integral with the platelike gripper block 56. Disposed between the boss 65 of the pivot arm 54 and the lower inside of the longitudinal groove 64 is a spring 66 which urges the gripper block 56 against the gripper finger 44. Associated with the pivot arm 54 is a rocker arm 67 which operates as a stop and is mounted on part 35. The rocker arm 67 can be pivoted against the force of a spring 68 supported on part 35. As may be seen from FIG. 4, a rocker arm 69 with a spring 70 is associated also with the corresponding pivot arm 55.

Figure 7:
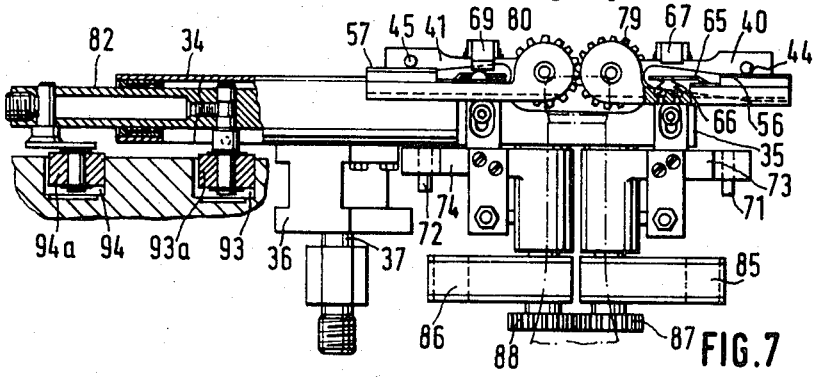
Figure 8:
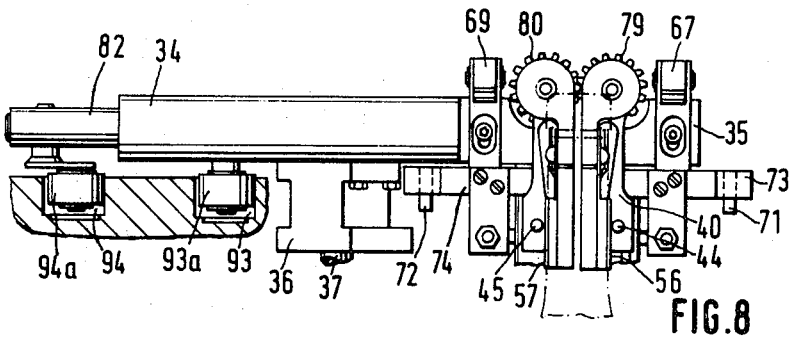
Figure 9:
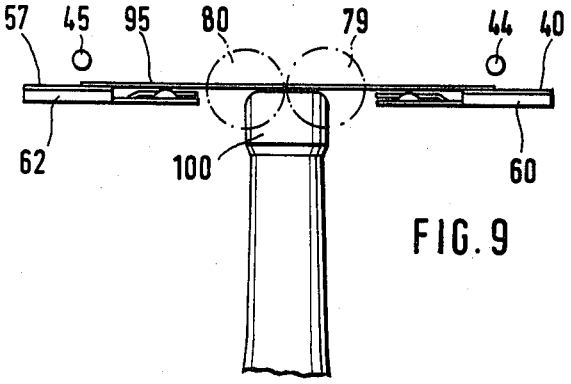
FIGS. 9 to 11 show the gripper block and the associated gripper fingers in positions corresponding to those of FIGS. 6 to 8 during the strip-label applying operation.
Figure 10:
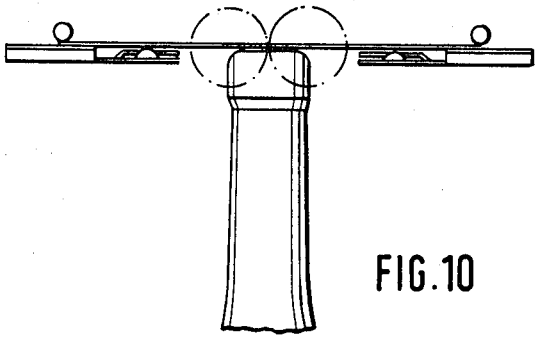
Figure 11:
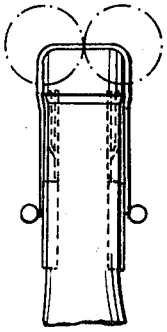

The springs 66, 68 and 70 are designed so that when the pivot arms 40, 41, 54, and 55 are pivoted jointly into the position shown in FIGS. 2, 7 and 10, in other words, in the direction of the stops of the rocker arms 67 and 69, the springs 66 are first compressed and the pivot arms 54 and 55 of the gripper blocks 56 and 57 are thus stopped. As they are pivoted further into the position shown in FIGS. 6 and 7, the gripper fingers 44 and 45 lift off the gripper blocks 56 and 57. When after the springs 66 have been compressed the bosses 65 of the pivot arms 54 and 55 come to abut on the lower insides of the longitudinal grooves 60 of the pivot arms 40 and 41, the latter entrain the pivot arms 54 and 55 during their continued pivoting movement while overcoming the force of the springs of the rocker arms 67 and 69.

As is apparent from FIGS. 6 to 11, the pivot axes of the pivot arms 40, 41, 54 and 55 are in alignment with the transitions from the top of the bottle to its sides.

Part 35 of the carrier is provided on the side opposite the gripper blocks 56 and 57 and the gripper fingers 44 and 45 with a clamp 21 and applicators 71 and 72, all of which operate in the manner of tongs. In a manner analogous to the mounting and the drive of the pivot arms 40, 41, 54 and 55, pivot arms 73 and 74 of the applicators 71 and 72 are pivotably mounted by means of sleeves 77 and 78 on studs 75 and 76 which are parallel to each other but vertical. The sleeves 77 and 78 carry pinions 79 and 80 which are in mesh with each other. Pinion 80 is further in mesh with the teeth 81 of a rack 82 which is axially guided in part 34 of the carrier.

Mounted in the sleeves 77 and 78 by means of studs 83 and 84 for free rotation are pivot arms 85 and 86 which carry the clamp 21. The pivot arms 85 and 86 are connected to rotate together by means of pinions 87 and 88 seated on the studs 83 and 84. The pivot arms 73 and 85 on the one hand and the pivot arms 74 and 86 on the other hand are coupled together through a spring 91 or 92, respectively, disposed on an arcuate guide 89 or 90, respectively, in such a way that when the pivot arms 73 and 74 are pivoted by the agency of the rack 82, the pivot arms 85 and 86 are also pivoted until the clamp 21 comes to bear on the bottle 2 to be held. The pivot arms 73 and 74 can be pivoted further against the force of the springs 91 and 92 until the applicators 71 and 72 which penetrate through the notches 58 and 59 of the gripper blocks 65 and 57 come to bear on the bottle 2.

The axial displacement of the racks 51 and 82 controls the movements of both pivot-arm pairs 40/41, 54/55 and 73/74, 85/86. For axial displacement of the racks 51 and 82, closed, fixed grooved cams 93 and 94 disposed in one plane are provided which are engaged by the racks 51 and 82 through followers 93*a* and 94*a* in the form of rollers.

When a plurality of strip-label applying units is disposed on a turret 20, the clamp 21 and the applicators 71 and 72 of one unit cooperate with the gripper blocks 56 and 57 and the gripper fingers 44 and 45 of the adjacent unit in dealing with a given bottle 2.

Figure 15:
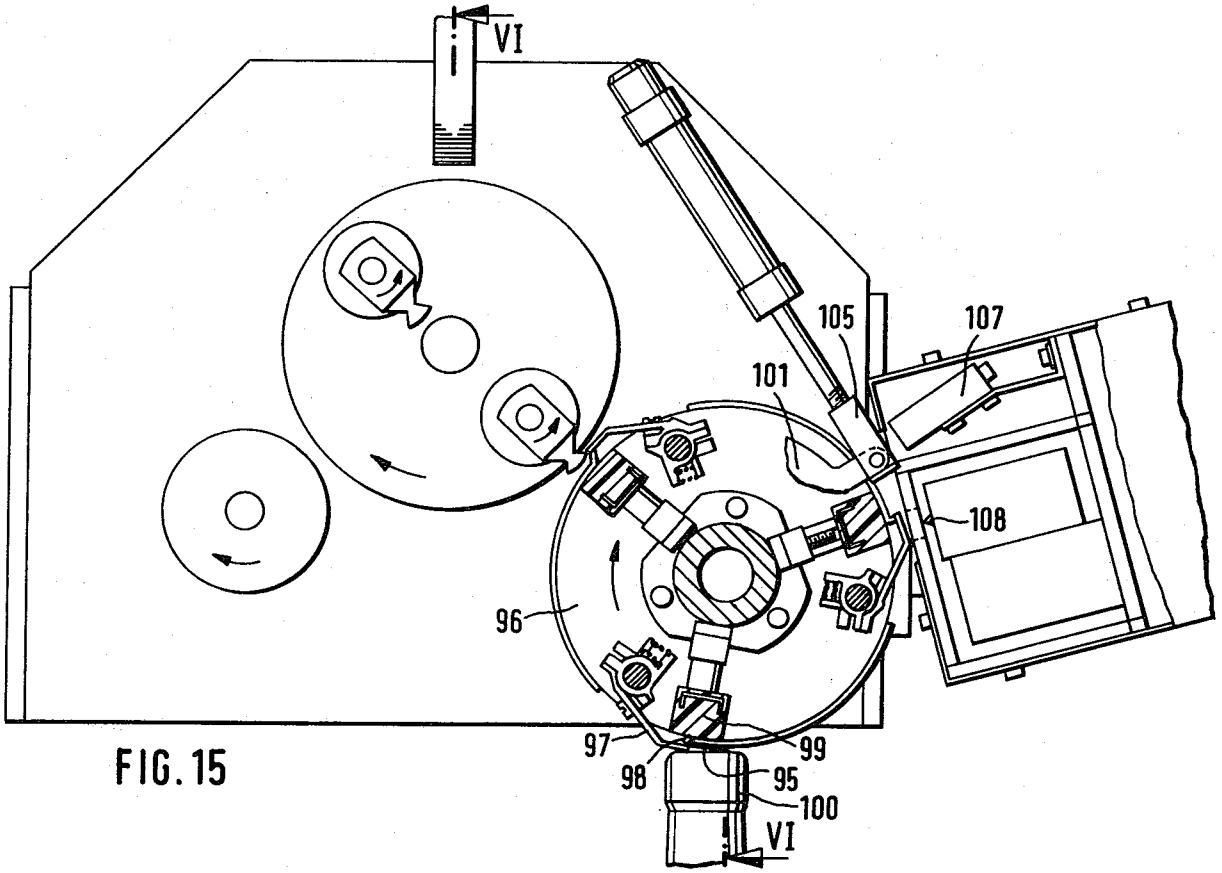
FIG. 15 is a side elevational and partial sectional view, taken from the direction of the arrow A in FIG. 1, of a labeling station disposed above the applicator means according to FIG. 2.
Figure 16:
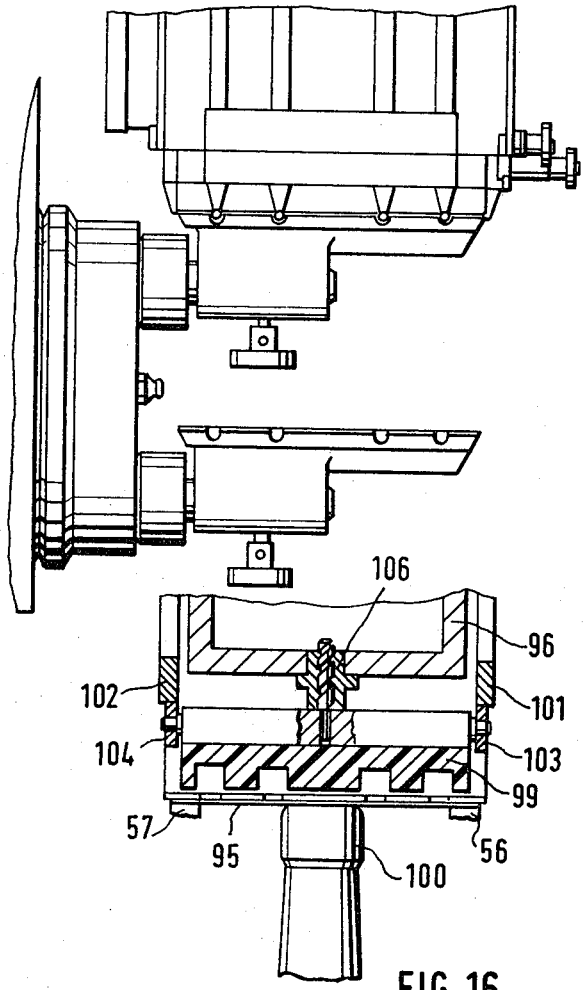
FIG. 16 shows a section through the labeling station of FIG. 13 along the line VI—VI in FIG. 15.

The labeling station 23 which in FIGS. 15 and 16 is disposed above the turret 20 comprises as a transfer mechanism for the strip labels 95 a gripper cylinder 96 from which the gluecoated strip labels 95, held parallel to its generatrices by gripper fingers 97 and gripper blocks 98, can be transferred by means of a radially advanceable applicator 99 to the gripper blocks 56 and 57 and to the face of the bottle top 100.

For the radial advance of the applicator 99, a dual disk cam 101 and 102 is provided on which the applicator 99 is supported through rollers 103 and 104. When the rollers 103 and 104 ride over a lobe, the applicator 99 is forced radially outward.

As is apparent from FIG. 16, the disk cams 101 and 102 are acted upon by a positioning member 104 which is adapted to rotate them about the gripper-cylinder axis. By rotating the disk cams 101 and 102, provision is made for the applicators 99 to be advanced, not toward the gripper blocks 56 and 57 and the face of the bottle top 100 but toward a point angularly offset therefrom. This mode of operation of the applicators 99 is desired when no label is held ready for transfer by the gripper finger 97 and the gripper block 98. In this way, the applicators are prevented from coming into contact with the glue adhering to the gripper blocks 56 and 57 and thus being fouled. Fouled applicators would soil the face of a label to be transferred. The positioning member 104 is controlled by a monitoring means which in the event of a missing bottle delivers the command NO LABEL to the labeling station.

As may be seen from FIG. 16, the applicator 99 is guided in a guide sleeve 106 provided with a coarse thread so that as it is radially advanced the strip label 95 is pivoted about its center over the bottle top 100. This pivoting movement serves for coordination of the rates of movement. When the rate of movement of the gripper cylinder 96 coincides with the rate of movement of the bottle top 100, then the rate of movement of the outer gripper block 56 is higher and that of the inner gripper block 57 is lower in relation to the ends of the label. By superimposing the pivoting movement of the applicators 99, the outer end of the label is accelerated and its inner end is retarded.

Figure 14:
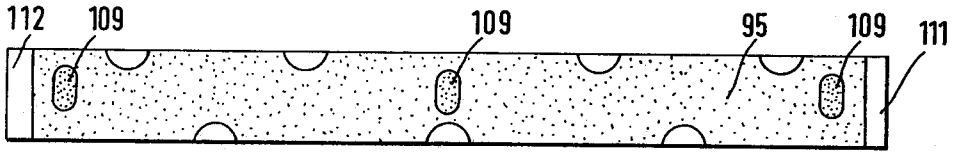
FIG. 14 shows the glue-coated back of a strip label.
Figure 12:
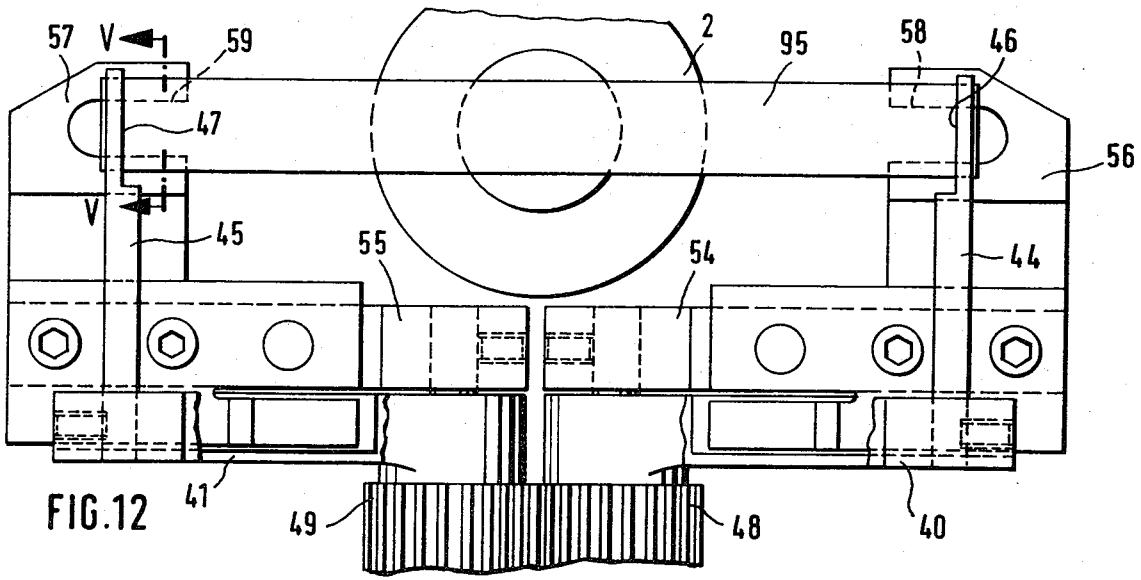
FIG. 12 is a top plan view of the gripper block and the associated gripper fingers holding a strip label.
Figure 13:
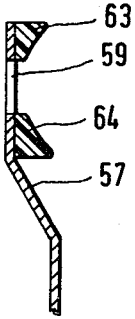
FIG. 13 shows a section through a gripper block along the line V—V in FIG. 12.

Disposed on the outer circumference of the gripper cylinder 97 are spray nozzles 108 which are controlled by a sensor 107 and which spray hot-melt adhesive in spurts onto the sites 109 in FIG. 14, which do not come into contact with the gripper blocks 56 and 57. The hot-melt adhesive applied to the sites 109 serves for the rapid fixing in place of the strip label 95 applied to the bottle 2 by the applicator means comprising the applicators 71, 72 and 99.

Figure 17:
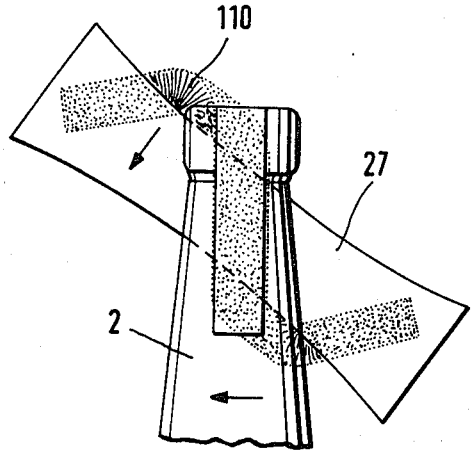
FIG. 17 is a view of a brush in elevation as seen in direction X in FIG. 1.

According to FIG. 1, the circular brush 27 which is disposed outside the outfeed starwheel 24 and whose outer contour is concave, and the opposite circular brush 28 which is disposed on the inside and whose outer contour is convex, have a helical complement of bristles that is lower on the inlet side. As is apparent from FIG. 17, both brushes 27 and 28 are angularly positioned in such a way that the bottles 2 coming within the reach of the brushes 27 and 28 are first acted upon at the lower end of the strip label 95 and then, as they keep moving, all the way up to the face of the bottle top 100. The helical complement of bristles 110 of the brushes 27 and 28 runs parallel to the axis of the bottle so that with an appropriate peripheral speed of the brushes 27 and 28 and an appropriate conveying speed of the bottle 2 only downwardly directed forces act on the strip label 95 to smooth it. The radially resilient press-on rollers 29 to 32 disposed downstream of the brushes 27 and 28 are mounted on vertical pins for rotation thereabout. While the rollers 29 and 30 are driven in synchronism with the conveying speed of the bottles 2 to minimize stresses on the strip labels 95, the rollers 31 and 32 rotate freely.

The principle of operation of the applicator means described is as follows:

The strip label 95, glue-coated in the labeling station 25 with the exception of narrow end regions 111 and 112, is carried by the gripper cylinder 96 to a point above the gripper blocks 56 and 57 and the bottle top 100 and, due to the unidirectional motion of the gripper cylinder 96, the bottle top 100 and the gripper blocks 56 and 57, and due to the superimposed pivoting movement of the applicator 99 upon its being advanced, is transferred at synchronous speed to the face of the bottle top 100 and the gripper blocks 56 and 57. To enable the gripper blocks 56 and 57 to pick up the strip label 95, the pivot arms 40, 41, 54 and 55 are pivoted into the positions shown in FIGS. 6 and 9, in which the gripper fingers 44 and 45 have lifted off the gripper blocks 56 and 57. The strip label 95, which has been moved by the applicator 99 toward the gripper blocks 56 and 57, slides over the gripper fingers 44 and 45 in proximity to the notches 46 and 47 and then adheres to the gripper blocks 56 and 57. The end regions 111 and 112 which slide over these notches 46 and 47 have not been glue-coated, and the gripper fingers 44 and 45 therefore are not fouled with glue. Then, in being retracted into the position shown in FIGS. 7 and 10, the gripper fingers 44 and 45 act on the face of the strip label 95, pressing it against the gripper blocks 56 and 57. The pivot arms 40, 41, 54 and 55 then are pivoted jointly into the position shown in FIGS. 8 and 11. In the process, the strip label 95 is precisely positioned by its ends on the sides of the bottle top 100. If the pivot axis is in alignment with the transitions from the top to the sides of the bottle top 100, such positioning will entail no stresses on the strip label. However, if the strip label 95 is to be drawn taut in the process, the pivot axes are slightly offset relative to the bottle. The strip label so positioned is then gripped by the applicators 71 and 72 and pushed through the notches 58 and 59 in the gripper blocks 56 and 57. A slight retracting of the latter then causes the edges of the label to slip over the edges of the notches 58 and 59, and thus in front of the press pads 60 to 63 disposed on the back of the gripper blocks 56 and 57. When the latter then are again advanced toward the bottle 2, the press pads 60 to 63 press the strip label 95 onto the bottle by the edges which are not held by the applicators 71 to 72.

The bottle 2 thus provided with a strip label 95 then passes into the outfeed starwheel 24, where the strip label 95 is pressed onto the bottle over the remaining areas by the brushes 27 and 28 and the rollers 29 to 31.

It will be appreciated that the instant specification and claims are set forth by way of illustration and not of limitation, and that various changes and modifications may be made without departing from the spirit and scope of the present invention.

What is claimed is:

1. An apparatus for affixing strip labels to container closures, comprising a transfer mechanism for strip labels, an applicator adapted to advance toward two opposite sides of a container to be labeled and to press the label onto the container, two gripping members for picking up a strip label from the transfer mechanism, said gripping members being adapted to grasp the ends of the strip label when said ends are held by the transfer mechanism over the container, and means for pivoting said gripping members while grasping said strip label ends to carry said gripping members from pickup positions over paths which are in the same plane as the axis of the container into a transfer position at the sides of the container.

2. An apparatus according to claim 1, wherein the means for pivoting the gripper members comprises pivot arms having pivot axes.

3. An apparatus according to claim 2, including a clamp for securing the container against rotation and positioned below the area to be labeled, the clamp and the pivot arms of the applicators for the label end portions being pivotable about the same pivot axis.

4. An apparatus according to claim 3, wherein on each pivot arm of the applicators the associated freely rotatable pivot arms of the clamp is supported by means of a spring.

5. An apparatus according to claim 3, wherein the pivot arms of the applicators and of the clamp are coupled to a cam-controlled drive.

6. An apparatus according to claim 5, wherein the pivot arms of the applicators are coupled together through meshing pinions, and to the drive through a rack meshing with one of said pinions.

7. An apparatus according to claim 3, wherein the pivot axes of the pivot arms of the gripper fingers of the gripper blocks are disposed at right angles to the pivot arms of the applicators and of the clamp.

8. An apparatus according to claim 1 wherein the gripping members are provided with gripper blocks from which the applicators strip the ends of the strip labels in the transfer position at the sides of the container and press them against the sides of the container.

9. An apparatus according to claim 8, wherein the gripper blocks are provided with notches which are open to allow penetration by the applicators and passage of the ends of a label.

10. An apparatus according to claim 8, wherein the gripper blocks are provided with press pads on their backs directed toward the container.

11. An apparatus according to claim 8, wherein a gripper finger is associated with each gripper block for securing a label to the gripper block.

12. An apparatus according to claim 11, wherein each gripper finger is carried by a pivot arm adapted to be pivoted about the pivot axis of the associated gripper block.

13. An apparatus according to claim 11, wherein between the pivot arm of each gripper finger and the freely pivotable pivot arm of the associated gripper block there is provided a spring which urges the gripper block against the gripper finger.

14. An apparatus according to claim 11, wherein there is associated with the pivot arm of each gripper block a stop operative in the transfer position.

15. An apparatus according to claim 12, wherein the stop is supported on a spring that is stronger than the spring between the pivot arms.

16. An apparatus according to claim 12, wherein at least one of the pivot arms of the gripper fingers is coupled to a cam-controlled drive.

17. An apparatus according to claim 12, wherein the pivot arms of the gripper fingers are coupled together through meshing pinions and to the drive through a rack meshing with one of said pinions.

18. An apparatus according to claim 8, including a plurality of applicator pairs and gripper-block pairs arranged in a row in the direction of travel of the container to be labeled, an applicator pair each being provided on one side and a gripper-block pair each being provided on the opposite side of a carrier common to both, and constructed as an interchangeable unit.

19. An apparatus according to claim 18, wherein a plurality of interchangeable units making up a carrier comprising applicators and gripper blocks is disposed on a turret comprising a number of pockets for containers to be labeled that corresponds to the number of said units.

20. An apparatus according to claim 16 or 20, wherein the drives for the rack comprises a fixed cam and a cam follower for the rack.

21. An apparatus according to claim 1, wherein the transfer mechanism is constructed as the gripper cylinder of a labeling station.

22. An apparatus according to claim 1, wherein the transfer mechanism for the strip labels is provided with advanceable applicators for the end portions of the label.

23. An apparatus according to claim 22, wherein the applicators follow the contour of a disk cam by means of a cam follower during rotation of the transfer mechanism.

24. An apparatus according to claim 23, wherein the disk cam can be positioned through a positioning member in such a way that the point at which the applicators are advanced is offset relative to the gripper blocks.

25. An apparatus according to claim 25, wherein the applicators of the transfer mechanism are guided in a guide track which accelerates or retards the applicators as they advance toward a container and the gripper blocks for the purpose of coordinating their rate of movement with that of the gripper blocks.

26. An apparatus according to claim 25, wherein said guide track is a coarse thread.

27. An apparatus according to claim 21, wherein there are associated with the circumference of the gripper cylinder hot-melt adhesive spray nozzle applicator means actuable in spurts, whereby the hot-melt adhesive can be applied to areas in the middle and at the ends of the label which do not come into contact with the gripper blocks.

28. An apparatus according to claim 1, wherein the applicator is located at the entrance or exit of a labeling station for belly and/or breast and/or neck labels.

29. An apparatus according to claim 28, wherein the labeling station includes an outfeed starwheel having pockets each associated with a clamp which picks up the container to be labeled, in the angular position in which it is oriented, from its pocket in the labeling station and transfers it in that position to a clamp on a turret carrying the applicator.

30. An apparatus according to claim 19, including a rotating circular brush positioned axially at such an angle, allowing for the conveying speed of the containers and the peripheral speed of the brush, that the portion of the brush which is effective at a given instant is parallel to the axis of the bottle.

31. An apparatus according to claim 30, wherein the brush has a helical complement of bristles, the bristle sections directed toward the container extending parallel to the desired affixing direction.

32. An apparatus according to claim 31, wherein the width of the complement of bristles in the direction of travel of the container is substantially the same as the width of the label to be affixed.

33. An apparatus according to claim 30, wherein the lowermost part of the brush is located at the point where the container enters the brush section.

34. An apparatus according to claim 30, wherein the containers are conveyed along a curved path, a circular brush having a convex contour being disposed on the inside of said path and a circular brush having a concave contour being disposed on the outside of said path.

35. An apparatus according to claim 30, including a radially resilient press-on roller disposed downstream of the brush along the conveying path of the containers.

36. An apparatus according to claim 35, wherein the first press-on roller in the direction of travel is driven in synchronism with the conveying speed of the container.

* * * * *

UNITED STATES PATENT AND TRADEMARK OFFICE

CERTIFICATE OF CORRECTION

PATENT NO. : 4,388,143

DATED : Jun. 14, 1983

INVENTOR(S) : Rainer Buchholz et al

It is certified that error appears in the above-identified patent and that said Letters Patent are hereby corrected as shown below:

Column 12, line 28, Delete "12" and insert --14--.

Column 12, line 51, Delete "20" and insert --5--.

Column 13, line 1, Delete "25" and insert --21--.

Signed and Sealed this

*Sixteenth* Day of *October 1984*

[SEAL]

*Attest:*

GERALD J. MOSSINGHOFF

*Attesting Officer*

*Commissioner of Patents and Trademarks*